US010941623B2

(12) United States Patent
Yang et al.

(10) Patent No.: US 10,941,623 B2
(45) Date of Patent: Mar. 9, 2021

(54) APPARATUS AND METHOD FOR CLEANING ROCK DEBRIS WHEN DEEP-WATER SURFACE DRILLING IS DONE

(71) Applicant: China University of Petroleum—Beijing, Beijing (CN)

(72) Inventors: Jin Yang, Beijing (CN); Qishuai Yin, Beijing (CN); Shanshan Shi, Beijing (CN)

(73) Assignee: China University of Petroleum-Beijing, Beijing (CN)

( * ) Notice: Subject to any disclaimer, the term of this patent is extended or adjusted under 35 U.S.C. 154(b) by 154 days.

(21) Appl. No.: 16/436,139

(22) Filed: Jun. 10, 2019

(65) Prior Publication Data

US 2020/0072003 A1 Mar. 5, 2020

(30) Foreign Application Priority Data

Aug. 31, 2018 (CN) ..... 201811008366.8

(51) Int. Cl.

| | |
|---|---|
| ***E21B 21/00*** | (2006.01) |
| *E21B 7/124* | (2006.01) |
| *E21B 10/60* | (2006.01) |

(52) U.S. Cl.

CPC ..... *E21B 21/001* (2013.01); *E21B 7/124* (2013.01); *E21B 10/60* (2013.01)

(58) Field of Classification Search

CPC ..... E21B 21/001; E21B 7/124; E21B 10/60; E21B 17/006; E21B 17/1014;

(Continued)

(56) References Cited

U.S. PATENT DOCUMENTS 3,757,876 A * 9/1973 Pereau ..... E21B 19/08 175/267
4,055,224 A * 10/1977 Wallers ..... E02D 15/08 175/5

(Continued)

FOREIGN PATENT DOCUMENTS

CN 103015924 A 4/2013
CN 203022661 A 6/2013

(Continued)

OTHER PUBLICATIONS

Exploration on application of cuttings cleaning machine for water-saving oil drilling, Digital communication World, No. 7, 2015.

(Continued)

*Primary Examiner* — Matthew Troutman
*Assistant Examiner* — Patrick F Lambe
(74) *Attorney, Agent, or Firm* — Young Basile Hanlon & MacFarlane, P.C.

(57) ABSTRACT

The present disclosure provides an apparatus and method for cleaning rock debris when deep-water surface drilling is done. The apparatus for cleaning rock debris when deep-water surface drilling is done comprises: an open barrel having an open through groove which is axially provided; a plurality of debris cleaning mechanisms connected to the open barrel at an interval in a circumferential direction of the open barrel, wherein each of the debris cleaning mechanisms comprises: a fixed block connected to an outer wall of the open barrel; a debris cleaning leg having one end rotatably connected to the fixed block, and the other end provided with a debris cleaning impeller; and a pull rod having one end connected to the outer wall of the open barrel above the fixed block, and the other end movably connected to the debris cleaning leg. The present disclosure not only cleans a large amount of rock debris accumulated around the seabed surface conduit while drilling is done in the deep-water (Continued)

surface drilling process, but also achieves the purpose of continuous working in the deep-water surface drilling process, without the need of frequent tripping in and out in midway to adjust the position of the apparatus for cleaning rock debris when deep-water surface drilling is done.

9 Claims, 2 Drawing Sheets

(58) Field of Classification Search
CPC ..... E21B 17/1021; E21B 17/16; E02D 13/08; E04H 12/34; E04H 12/347
USPC ..... 175/5
See application file for complete search history.

(56) References Cited

U.S. PATENT DOCUMENTS 6,354,767 B1 * 3/2002 Jones ..... E02D 13/04 405/232
7,182,157 B2 * 2/2007 Zupanick ..... E21B 7/28 175/107
7,950,463 B2 * 5/2011 Fossli ..... E21B 7/20 166/358
8,608,411 B2 * 12/2013 Biserna ..... E02D 3/126 405/269
8,684,629 B2 * 4/2014 Asplund ..... E02D 27/52 405/224
2005/0016727 A1 1/2005 Fields
2005/0279498 A1 * 12/2005 Nakajima ..... E21B 17/1021 166/255.2
2012/0255724 A1 10/2012 Hallundbæk
2018/0202183 A1 * 7/2018 Moore ..... E04H 12/347

FOREIGN PATENT DOCUMENTS

CN 206144492 A 5/2017
CN 206280016 A 6/2017

OTHER PUBLICATIONS

Design of Washing Machine for Drilling Cuttings, Oil Field Equipment, vol. 39, No. 10.
Special PCT Search Report, dated Mar. 19, 2019.

* cited by examiner

APPARATUS AND METHOD FOR CLEANING ROCK DEBRIS WHEN DEEP-WATER SURFACE DRILLING IS DONE

TECHNICAL FIELD

The present disclosure relates to a technical field of marine deep-water drilling, and in particular to an apparatus and method for cleaning rock debris when deep-water surface drilling is done during deep-water open drilling.

BACKGROUND ART

With a continuous improvement of the marine oil exploitation technology and marine equipment in China, oil and natural gas exploitation regions gradually extend from the land and neritic regions to deep-water regions. Due to a deep depth of the deep-water region, the diagenetic compaction of the marine shallow stratum is weak, and the surface stratum fracture pressure is extremely low, resulting in extremely narrow surface safety mud window during drilling in the marine deep-water region. Thus, the deep-water surface drilling is generally embodied by the seawater open drilling in which seawater is directly used as the drilling fluid to carry the bottom-hole rock debris to be above the mud surface and directly discharge them around the surface conduit. Although this method solves the problem of the small safety window for the surface drilling while ensuring the marine ecological environmental protection, a large amount of rock debris generated by the surface drilling are accumulated around the surface conduit and cannot be effectively cleaned, resulting in great risks in subsequent operations of seating a underwater wellhead and seating a subsea tree. Therefore, it is very important to develop an economical and convenient apparatus and method for cleaning rock debris when deep-water open drilling is done, so as to solve the difficulty in cleaning the rock debris when marine deep-water surface drilling is done.

SUMMARY OF THE DISCLOSURE

An object of the present disclosure is to provide an apparatus and method for cleaning rock debris when deep-water surface drilling is done, which not only cleans a large amount of rock debris accumulated around a seabed surface conduit while drilling is done in a deep-water surface drilling process, but also achieves the purpose of continuous working in the deep-water surface drilling process, without the need of frequent tripping in and out in midway to adjust the position of the apparatus for cleaning rock debris when deep-water surface drilling is done.

The object of the present disclosure can be achieved by the following technical solutions:

The present disclosure provides an apparatus for cleaning rock debris when deep-water surface drilling is done, comprising:

an open barrel having an open through groove which is axially provided;

a plurality of debris cleaning mechanisms connected to the open barrel at an interval in a circumferential direction of the open barrel, wherein each of the debris cleaning mechanisms comprises:

a fixed block connected to an outer wall of the open barrel;

a debris cleaning leg having one end rotatably connected to the fixed block, and the other end provided with a debris cleaning impeller; and a pull rod having one end connected to the outer wall of the open barrel above the fixed block, and the other end movably connected to the debris cleaning leg.

The present disclosure further provides a method for cleaning rock debris when deep-water surface drilling is done, which is implemented by the apparatus for cleaning rock debris when deep-water surface drilling is done as described above, comprising:

step S1: inserting a drill string into the open barrel, the drill string being connected at a lower end thereof with a drill tool;

step S2: lowering the drill string until the apparatus for cleaning rock debris when deep-water surface drilling is done is located above a seabed surface conduit;

step S3: stretching and seating the debris cleaning leg of each of the debris cleaning mechanisms on an upper end face of the seabed surface conduit, wherein the debris cleaning impeller of each of the debris cleaning mechanisms is located at an outer periphery of the seabed surface conduit; and step S4: continuing to lower the drill string until the drill tool reaches a well bottom, and starting the drill tool to perform a drilling operation, wherein the apparatus for cleaning rock debris when deep-water surface drilling is done is driven by the drill string to rotate, and rock debris around the seabed surface conduit is cleaned by the debris cleaning impeller of each of the rock debris mechanisms.

The apparatus and method for cleaning rock debris when deep-water surface is done drilling according to the present disclosure have the following characteristics and advantages: the apparatus and method for cleaning rock debris can clean up a large amount of rock debris accumulated at a seabed surface conduit in a deep-water open drilling process, and reduce the operation risk and difficulty to a greatest extent in the subsequent operation of seating a underwater wellhead. The apparatus for cleaning rock debris when deep-water surface drilling is done is simple in structure, easy to use and low in cost, and can continuously work in the drilling processes of the first and second sections.

DETAILED DESCRIPTION OF THE PREFERRED EMBODIMENTS

The technical solutions in the embodiments of the present disclosure will be clearly and completely described as follows with reference to the drawings in the embodiments of the present disclosure. Obviously, those as described are merely parts, rather than all, of the embodiments of the present disclosure. Based on the embodiments of the present disclosure, any other embodiment obtained by a person skilled in the art without paying any creative labor should fall within the protection scope of the present disclosure.

Embodiment 1

Figure 1:
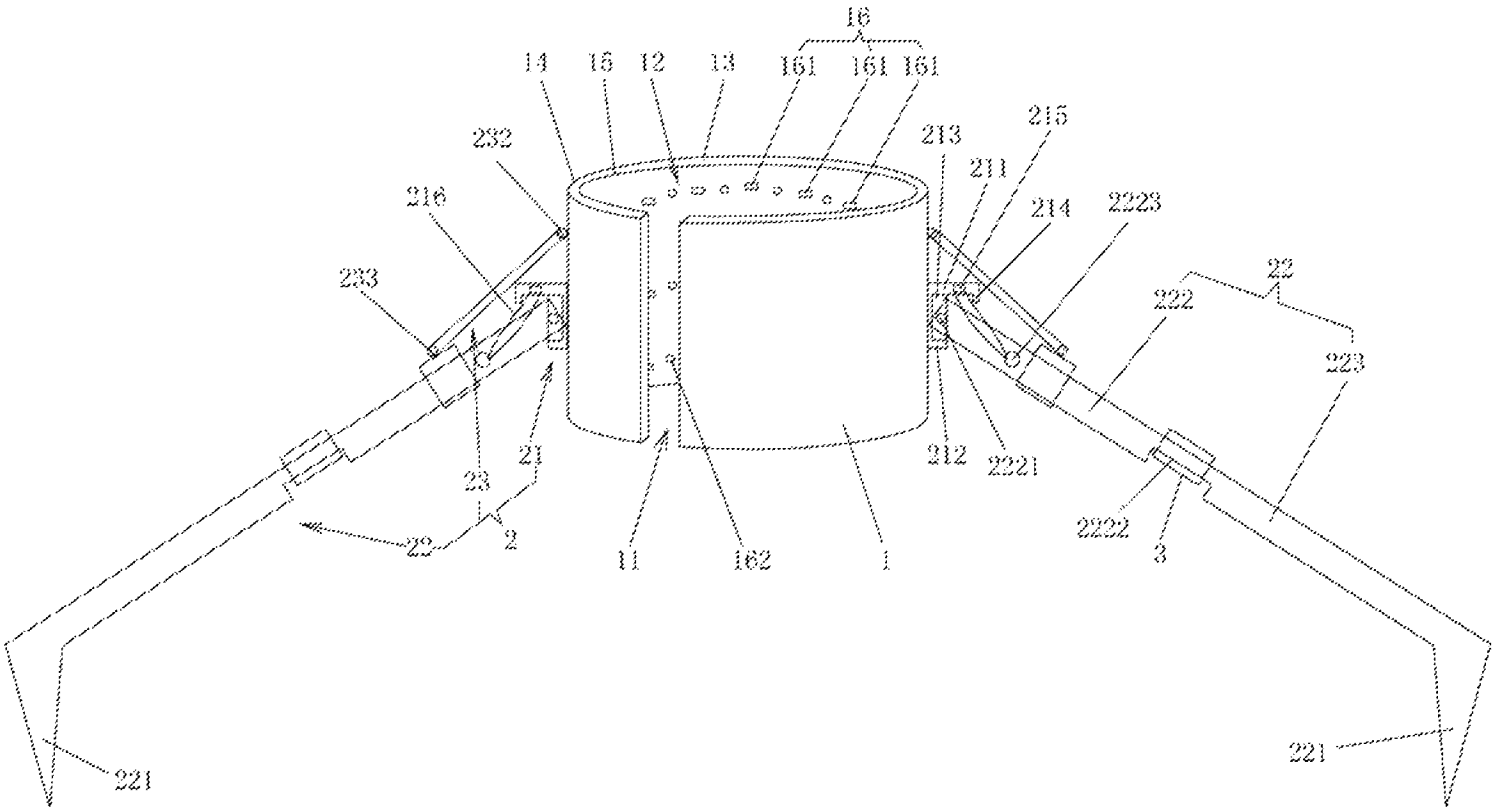
FIG. 1 is a schematic diagram of an apparatus for cleaning rock debris when deep-water surface drilling is done according to the present disclosure.
Figure 2:
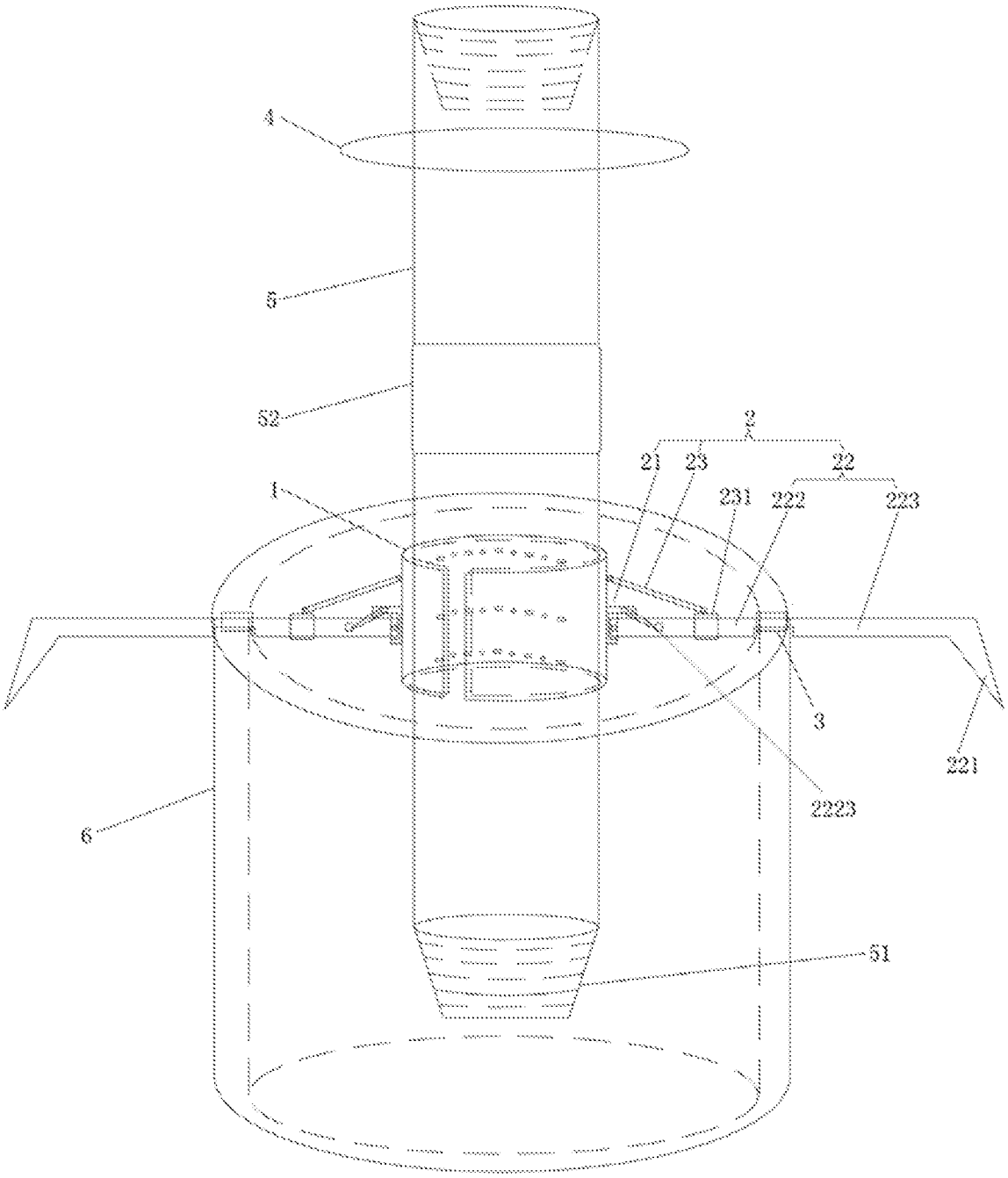
FIG. 2 is a schematic diagram of an apparatus for cleaning rock debris when deep-water surface drilling is done according to the present disclosure in a working state.

As illustrated in FIGS. 1 and 2, the present disclosure provides an apparatus for cleaning rock debris when deep-water surface drilling is done, comprising an open barrel 1 having an open through groove 11 which is axially provided, and a plurality of debris cleaning mechanisms 2 connected to the open barrel 1 at an interval in a circumferential direction of the open barrel 1; wherein each of the debris cleaning mechanisms 2 comprises: a fixed block 21 connected to an outer wall of the open barrel 1; a debris cleaning leg 22 having one end rotatably connected to the fixed block 21, and the other end provided with a debris cleaning impeller 221; and a pull rod 23 having one end connected to the outer wall of the open barrel 1 above the fixed block 21, and the other end movably connected to the debris cleaning leg 22.

Specifically, the open barrel 1 is made of steel, with a central passage 12 formed in a central portion thereof; an open through groove 11 is formed on a side wall of the open barrel 1, and communicated with the central passage 12. By the arrangement of the open through groove 11, the open barrel 1 can have a certain dilatational elasticity. In this embodiment, an inner diameter of the open barrel 1 is the same as an outer diameter of a drill string used in a marine oil drilling site; for example, it may be 5.5 inches or 5.875 inches.

Since the drill string used in the marine oil drilling site is provided thereon with a coupling, an outer diameter of which is slightly larger than an outer diameter of the open barrel 1, in the present disclosure, an upper end face of the open barrel 1 is designed as an annular inclined surface 13 with a certain inclination, which is inclined upward in a radially outward direction, i.e., a horizontal height of an upper end outer edge 14 of the outer wall of the open barrel 1 is larger than a horizontal height of an upper end outer edge 15 of an inner wall of the open barrel 1. In this way, it ensures that the open barrel 1 can be temporarily opened under a certain lowering force in the process of lowering the drill string, so that the coupling can smoothly pass through the central passage 12 of the open barrel 1, and the open barrel 1 can quickly return to the original state after the coupling passes through. In this embodiment, the inclination of the annular inclined surface is 18° to 20°.

Further, the open barrel 1 is provided on the inner wall with a plurality of rows of rolling structures 16, and each row of rolling structure 16 comprises a plurality of rollers 161 provided at an interval in a circumferential direction of the open barrel 1; rolling surfaces of the rollers 161 slightly protrude from the inner wall of the open barrel 1. In the present disclosure, the inner wall of the open barrel 1 is provided with three rows of rolling structures 16. Of course, in other embodiments, the inner wall of the open barrel 1 may also be provided with two, four, or more rows of rolling structures 16, which is not limited here. In this embodiment, the open barrel 1 is provided in the inner wall thereof with a plurality of grooves, and the rollers 161 are rollably provided in the grooves, for example, by inserting rotating shafts connected to two ends of the rollers 161 into two side walls of the grooves. The purpose of designing the plurality of rows of rolling structures 16 is to reduce the wear on the inner wall of the open barrel 1 during the lowering process of the drill string.

Further, a magnetic block 162 is provided between every two adjacent rollers 161 of the plurality of rollers, and connected to the inner wall of the open barrel 1. That is, a plurality of rows of magnetic structures are provided on the inner wall of the open barrel 1, and each row of magnetic structure has a plurality of magnetic blocks 162 provided at an interval in the circumferential direction of the open barrel 1. In this embodiment, the magnetic blocks 162 are cylindrical. Of course, in other embodiments, the magnetic blocks 162 may also be polygonal or of other shapes, which are not limited here. The magnetic blocks 162 are embedded into the inner wall of the open barrel 1, slightly protruded therefrom, and located in the same cylindrical surface as the rolling surfaces of the plurality of rollers 161. Under the action of the magnetic attraction force, the magnetic blocks 162 can tightly connect the open barrel 1 with the drill string.

When the drill string is provided to pass through the central passage 12 of the open barrel 1, the plurality of rollers 161 can reduce the contact area between the drill string and the open barrel 1, so that the drill string can quickly and safely move downward in the axial direction of the open barrel 1. At the same time, since the rollers 161 can roll only in the axial direction of the drill string without rotating in the circumferential direction of the open barrel 1, the open barrel 1 can rotate together with the drill string. In addition, the strong magnetic attraction force of the magnetic blocks 162 tightly connects the drill string with the inner wall of the open barrel 1, so as to further ensure that the open barrel 1 can rotate together with the drill string.

The plurality of debris cleaning mechanisms 2 are located on the outer wall of the open barrel 1, and connected to the open barrel 1 at an interval in the circumferential direction of the open barrel 1. In this embodiment, three debris cleaning mechanisms 2 are connected to the outer wall of the open barrel 1, and provided at an equal interval in the circumferential direction of the open barrel 1. Of course, in other embodiments, on the premise that the expansion deformation of the open barrel 1 is not affected, two, four or more debris cleaning mechanisms 2 may also be provided on the outer wall of the open barrel 1, which is not limited here.

The debris cleaning mechanism 2 comprises the fixed block 21, the debris cleaning leg 22 and the pull rod 23, and the specific structures thereof are described as follows:

The fixed block 21 comprises a top wall 211, a bottom wall 212, and two side walls 213 connected to two sides of the top and bottom walls 211 and 212; the top wall 211, the bottom wall 212, and one end of the two side walls 213 form a fixed end of the fixed block 21 so as to be welded with the outer wall of the open barrel 1, and the top wall 211, the bottom wall 212, and the other end of the two side walls 213 form an opening end of the fixed block 21 so that the debris cleaning leg 22 is inserted into the fixed block 21. In this embodiment, a length of the top wall 211 is larger than a length of the bottom wall 212, and an outer edge of the top wall 211 and an outer edge of the bottom wall 212 both limit the debris cleaning leg 22. Further, in this embodiment, a downward projection 214 is further provided at the outer edge of the top wall 211 to limit the debris cleaning leg 22.

The debris cleaning leg 22 comprises a debris cleaning body 222 and a debris cleaning plate 223, the debris cleaning body 222 having one end inserted into the fixed block 21 through the opening end of the fixed block 21 and rotatably connected to the fixed block 21, and the other end connected to the debris cleaning plate 223, and the other end portion of the debris cleaning plate 223 being connected to the debris cleaning impeller 221. In this embodiment, a length of the debris cleaning leg 22 is 2 m to 3 m.

Specifically, the debris cleaning body 222 is substantially in the shape of a cuboid rod, with one end provided with a through-hole through which a hinge pin 2221 passes; two ends of the hinge pin 2221 are connected to the two side walls 213 of the fixed block 21, respectively; an outer diameter of the hinge pin 2221 is slightly smaller than an inner diameter of the through-hole, so that the debris cleaning body 222 is rotatable around the hinge pin 2221, and a rotation limit positions are the outer edges of the top wall 211 and the bottom wall 212 of the fixed block 21, respectively. The other end of the debris cleaning body 222 is formed with a pillar 2222, which has an outer diameter smaller than that of the debris cleaning body 222, and a bearing 3 is disposed around the pillar 2222. During working, an outer periphery of the bearing 3 rotates with the debris cleaning legs 22 along a top end face of the seabed surface conduit to reduce the wear between the debris cleaning legs 22 and an upper end face of the seabed surface conduit. In this embodiment, a length of the pillar 2222 is larger than 1.5 inches, and an inner race diameter of the bearing 3 is the same as the outer diameter of the pillar 2222, so that the bearing 3 can be tightly fitted with the pillar 2222.

The debris cleaning plate 223 is substantially in the shape of a rectangular plate, with one end threadedly connected to the pillar 2222 of the debris cleaning body 222, and the other end welded with the debris cleaning impeller 221. In the present disclosure, the debris cleaning impeller 221 is a spiral blade with a length of 0.5 m, an axis of the debris cleaning impeller 221 is provided at a certain angle with a length direction of the debris cleaning impeller 223, and the debris cleaning impeller 221 is provided obliquely downward of the debris cleaning impeller 223, so that the rock debris around the seabed surface conduit can be cleaned conveniently. The debris cleaning plate 223 of the present disclosure is threadedly connected to the debris cleaning body 222, which facilitates the mounting and replacement of the bearing 3 on the debris cleaning body 222 on one hand, and the replacement of the debris cleaning plate 223 on the other hand.

In the present disclosure, the top wall 211 of the fixed block 21 is provided thereon with a pulley 215 which is rotatable in the horizontal direction, a through-hole 2223 is formed in the debris cleaning body 222, and a steel wire rope 216 is provided in the through-hole 2223 and wound around the pulley 215. Since the debris cleaning leg 22 is connected to the pulley 215 of the fixed block 21 by the winding of the steel wire rope 216, the debris cleaning leg 22 is also limited by the length of the steel wire rope 216 when rotating to the bottom wall 212 of the fixed block 21. The steel wire rope 216 and the bottom wall 212 of the fixed block 21 can maintain a certain opening angle between the debris cleaning leg 22 and the outer wall of the open barrel 1, which facilitates the later mounting of the apparatus. At the same time, the steel wire rope 216 will also produce a certain pulling force on the debris cleaning leg 22, thereby achieving a certain limiting effect on the debris cleaning leg 22.

The pull rod 23 is substantially in the shape of a rod, with one end rotatably connected to the outer wall of the open barrel 1, and the other end rotatably connected to a slider 231 which is disposed around the debris cleaning body 222.

In the present disclosure, the pull rod 23 is substantially in the shape of a cuboid rod, with two ends provided with through-holes or welded with connecting rings 232, respectively; a pair of lifting lugs are welded on the outer wall of the open barrel 1 and the slider 231, respectively, wherein the pair of lifting lugs connected to the outer wall of the open barrel 1 are located above the fixed block 21; the connecting rings 232 on the two ends of the pull rod 23 are provided in the corresponding pair of lifting lugs, respectively; and by means of hinge pins 233 passing through the lifting lugs and the connecting rings 232, the two ends of the pull rod 23 are rotatable around the hinge pins 233 in the two pairs of lifting lugs.

The slider 231 is substantially in the shape of a hollow cuboid, which passes through the debris cleaning body 222 of the debris cleaning leg 22. In this embodiment, rollable rolling balls or rollers may be embedded into two opposite inner walls of the slider 231 to facilitate the slider 231 to slide along the debris cleaning leg 22, so that the pull rod 23 can move with the lifting lugs connected to the slider 231.

As illustrated in FIG. 2, the working process of the apparatus for cleaning rock debris when deep-water surface drilling is done is as follows:

step 1: first, seating an apparatus for cleaning rock debris when deep-water surface drilling is done according to the present disclosure on a rotary table surface 4 of a marine oil drilling platform;

step 2: lifting up a drill string 5, so that a drill pipe male buckle 51 at a lowermost end of the drill string 5 passes through an open barrel 1 of the apparatus for cleaning rock debris when deep-water surface drilling is done, and continuing to lower the drill string 5 until a drill pipe joint 52 on the drill string 5 reaches an upper end of the open barrel 1;

step 3: releasing a hook hanging load until a lowering force received by the open barrel 1 meets a design value W1, the open barrel 1 being expanded by the drill pipe joint 52 under the action of the lowering force, and when the drill pipe joint 52 of the drill string 5 passes through the open barrel 1, restoring the hook hanging load for normal drilling operation in time;

step 4: connecting a drill tool, i.e., a drill assembly and a drill bit, to the drill pipe male buckle 51, and lowering the drill string 5 under the condition that the apparatus for cleaning rock debris when deep-water surface drilling is done can pass through an opening of the rotary table surface 4, wherein the apparatus for cleaning rock debris when deep-water surface drilling is done is lowered below the rotary table surface 4 along with the drill string 5; next, performing an operation of connecting the drill strings 5 until the apparatus for cleaning rock debris when deep-water surface drilling is done reaches an upper end face of the seabed surface conduit 6;

step 5: under the limiting effect of the fixed block 21 and the steel wire rope 216 of the apparatus for cleaning rock debris when deep-water surface drilling is done, the debris cleaning leg 22 of the apparatus for cleaning rock debris when deep-water surface drilling is done is in an open state and is seated on the upper end face of the seabed surface conduit 6; a maximum width of the apparatus for cleaning rock debris when deep-water surface drilling is done is larger than a maximum diameter of the seabed surface conduit 6, and the seabed surface conduit 6 limits a downward travel of the apparatus for cleaning rock debris when deep-water surface drilling is done; next, the operation of connecting the drill strings 5 is continued and the drill string 5 is lowered; when the drill pipe joint 52 of the drill string 5 reaches the apparatus for cleaning rock debris when deep-water surface drilling is done again, performing step 3;

step 6: when the drill bit of the drill tool is lowered to the well bottom, starting a drilling operation, wherein in the drilling process, the drill string 5 moves downward in the axial direction of the apparatus for cleaning rock debris when deep-water surface drilling is done, while the apparatus for cleaning rock debris when deep-water surface drilling is done is driven to rotate to clean a large amount of rock debris accumulated around the seabed surface conduit 6;

step 7: as the drill string 5 moves downward in the drilling process, when the drill pipe joint 52 reaches the apparatus for cleaning rock debris when deep-water surface drilling is done, releasing the hook hanging load until the lowering force received by the open barrel 1 meets the design value W1, which is set according to a drilling pressure in a surface open drilling process to ensure that the design value W1 is larger than a lowering force W2 received by the apparatus for cleaning rock debris when deep-water surface drilling is done when drilling at an open maximum drilling pressure; when the drill pipe joint 52 is just fitted with the apparatus for cleaning rock debris when deep-water surface drilling is done, restoring the hook hanging load and the rotation of the drill string 5, so that the debris cleaning leg 22 of the apparatus for cleaning rock debris when deep-water surface drilling is done is driven by the drill string 5 to keep rotating for a certain period of time to achieve the purpose of cleaning a large amount of rock debris accumulated around the seabed surface conduit 6 to a greatest extent, and observing a torque of the drill string 5 during cleaning;

step 8: when the torque decreases obviously, it can be determined that the rock debris accumulated around the seabed surface conduit 6 have been cleaned up, and step 3 may be performed, while the drilling operation may be continued according to step 7;

step 9: an on-site reaming operation may be performed according to step 3; at that time, the borehole is trimmed by the drill tool during the operation, wherein the apparatus for cleaning rock debris when deep-water surface drilling is done will rotate together with the drill string 5, so that a large amount of rock debris discharged during the trimming of the borehole can be cleaned; and step 10: when the drilling operation reaches a target position or a casing running operation needs to be carried out, a tripping-out operation can be performed after the rock debris around the seabed surface conduit 6 are cleaned up, wherein the apparatus for cleaning rock debris when deep-water surface drilling is done moves upward to the rotary table surface 4 of the drilling platform together with the drill pipe joint 52; as the apparatus for cleaning rock debris when deep-water surface drilling is done is lifted up, each of the rock debris cleaning legs 22 returns to a downward inclined open state under the action of gravity, so that the apparatus for cleaning rock debris when deep-water surface drilling is done can quickly and conveniently pass through the opening of the rotary table surface 4, and then a detachment operation is performed.

In the present disclosure, the apparatus for cleaning rock debris when deep-water surface drilling is done can clean up a large amount of rock debris accumulated at a seabed surface conduit 6 in a deep-water open drilling process, and reduce the operation risk and difficulty to a greatest extent in the subsequent operation of seating a underwater wellhead. The apparatus for cleaning rock debris when deep-water surface drilling is done is simple in structure, easy to use and low in cost, and can continuously work in the drilling processes of the first and second sections.

Embodiment 2

As illustrated in FIGS. 1 and 2, the present disclosure further provides a method for cleaning rock debris, which is implemented by the apparatus for cleaning rock debris when deep-water surface drilling is done as described in Embodiment 1. The specific structure, working principle and beneficial effects of the apparatus for cleaning rock debris when deep-water surface drilling is done will not be repeated here. The method for cleaning rock debris comprises the following steps:

step S1: inserting a drill string 5 into the open barrel 1, the drill string 5 being connecting at a lower end thereof with a drill tool;

step S2: lowering the drill string 5 until the apparatus for cleaning rock debris when deep-water surface drilling is done is located above a seabed surface conduit 6;

step S3: stretching and seating the debris cleaning leg 22 of each of the debris cleaning mechanisms 2 on an upper end face of the seabed surface conduit 6, wherein the debris cleaning impeller 221 of each of the debris cleaning mechanisms 2 is located at an outer periphery of the seabed surface conduit 6; and step S4: continuing to lower the drill string 5 until the drill tool reaches a well bottom, and starting the drill tool to perform a drilling operation, wherein the apparatus for cleaning rock debris when deep-water surface drilling is done is driven by the drill string 5 to rotate, and rock debris around the seabed surface conduit 6 is cleaned by the debris cleaning impeller 221 of each of the debris cleaning mechanisms 2.

Specifically:

step 1: first, seating an apparatus for cleaning rock debris when deep-water surface drilling is done according to the present disclosure on a rotary table surface 4 of a marine oil drilling platform;

step 2: lifting up a drill string 5, so that a drill pipe male buckle 51 at a lowermost end of the drill string 5 passes through an open barrel 1 of the apparatus for cleaning rock debris when deep-water surface drilling is done, and continuing to lower the drill string 5 until a drill pipe joint 52 on the drill string 5 reaches an upper end of the open barrel 1;

step 3: releasing a hook hanging load until a lowering force received by the open barrel 1 meets a design value W1, the open barrel 1 being expanded by the drill pipe joint 52 under the action of the lowering force, and when the drill pipe joint 52 of the drill string 5 passes through the open barrel 1, restoring the hook hanging load for normal drilling operation in time;

step 4: connecting a drill tool, i.e., a drill assembly and a drill bit, to the drill pipe male buckle 51, and lowering the drill string 5 under the condition that the apparatus for cleaning rock debris when deep-water surface drilling is done can pass through an opening of the rotary table surface 4, wherein the apparatus for cleaning rock debris when deep-water surface drilling is lowered below the rotary table surface 4 along with the drill string 5; next, performing an operation of connecting the drill strings 5 until the apparatus for cleaning rock debris when deep-water surface drilling reaches an upper end face of the seabed surface conduit 6;

step 5: under the limiting effect of the fixed block 21 and the steel wire rope 216 of the apparatus for cleaning rock debris when deep-water surface drilling is done, the debris cleaning leg 22 of the apparatus for cleaning rock debris when deep-water surface drilling is done is in an open state and is seated on the upper end face of the seabed surface conduit 6; a maximum width of the apparatus for cleaning rock debris when deep-water surface drilling is done is larger than a maximum diameter of the seabed surface conduit 6, and the seabed surface conduit 6 limits a downward travel of the apparatus for cleaning rock debris when deep-water surface drilling is done; next, the operation of connecting the drill string 5 is continued and the drill string 5 is lowered; when the drill pipe joint 52 of the drill string 5 reaches the apparatus for cleaning rock debris when deep-water surface drilling is done again, performing step 3;

step 6: when the drill bit of the drill tool is lowered to a well bottom, starting a drilling operation, wherein in the drilling process, the drill string 5 moves downward in an axial direction of the apparatus for cleaning rock debris when deep-water surface drilling is done, while the apparatus for cleaning rock debris when deep-water surface drilling is done is driven to rotate to clean a large amount of rock debris accumulated around the seabed surface conduit 6;

step 7: as the drill string 5 moves downward in the drilling process, when the drill pipe joint 52 reaches the apparatus for cleaning rock debris when deep-water surface drilling is done, releasing the hook hanging load until the lowering force received by the open barrel 1 meets the design value W1, which is set according to a drilling pressure in a surface open drilling process to ensure that the design value W1 is larger than a lowering force W2 received by the apparatus for cleaning rock debris when deep-water surface drilling is done when drilling at an open maximum drilling pressure; when the drill pipe joint 52 is just fitted with the apparatus for cleaning rock debris when deep-water surface drilling is done, restoring the hook hanging load and the rotation of the drill string 5, so that the debris cleaning leg 22 of the apparatus for cleaning rock debris when deep-water surface drilling is driven by the drill string 5 to keep rotating for a certain period of time to achieve the purpose of cleaning a large amount of rock debris accumulated around the seabed surface conduit 6 to a greatest extent, and observing a torque of the drill string 5 during cleaning;

step 8: when the torque decreases obviously, it can be determined that the rock debris accumulated around the seabed surface conduit 6 have been cleaned up, and step 3 may be performed, while the drilling operation may be continued according to step 7;

step 9: an on-site reaming operation may be performed according to step 3; at that time, the borehole is trimmed by the drill tool during the operation, wherein the apparatus for cleaning rock debris when deep-water surface drilling is done rotates together with the drill string 5, so that a large amount of rock debris discharged during the trimming of the borehole can be cleaned; and step 10: when the drilling operation reaches a target position or a casing running operation needs to be carried out, a tripping-out operation can be performed after the rock debris around the seabed surface conduit 6 are cleaned up, wherein the apparatus for cleaning rock debris when deep-water surface drilling is done moves upward to the rotary table surface 4 of the drilling platform together with the drill pipe joint 52; as the apparatus for cleaning rock debris when deep-water surface drilling is done is lifted up, each of the rock debris cleaning legs 22 returns to a downward inclined open state under the action of gravity, so that the apparatus for cleaning rock debris when deep-water surface drilling is done can quickly and conveniently pass through the opening of the rotary table surface 4, and then a detachment operation is performed.

In the present disclosure, the method for cleaning rock debris can clean up a large amount of rock debris accumulated at a seabed surface conduit 6 in a deep-water open drilling process, and reduce the operation risk and difficulty to a greatest extent in the subsequent operation of seating an underwater wellhead. The method for cleaning rock debris can realize continuously working of the apparatus for cleaning rock debris when deep-water surface drilling is done in the drilling processes of the first and second sections.

Those described above are just several embodiments of the present disclosure. A person skilled in the art can make various changes or modifications to the embodiments of the present disclosure according to the content disclosed by the application document, without deviating from the spirit or scope of the present disclosure.

The invention claimed is:

1. An apparatus for cleaning rock debris when deep-water surface drilling is done, comprising:

an open barrel having an open through groove which is axially provided; and a plurality of debris cleaning mechanisms connected to the open barrel at an interval in a circumferential direction of the open barrel, wherein each of the debris cleaning mechanisms comprises:

a fixed block connected to an outer wall of the open barrel;

a debris cleaning leg having one end rotatably connected to the fixed block, and the other end provided with a debris cleaning impeller, the debris cleaning leg comprising: a debris cleaning body and a debris cleaning plate; and a pull rod having one end connected to the outer wall of the open barrel above the fixed block, and the other end movably connected to the debris cleaning leg;

wherein a bearing is provided around one end of the debris cleaning body connected to the debris cleaning plate and configured to rotate along a top end face of a seabed surface conduit.

2. The apparatus for cleaning rock debris when deep-water surface drilling is done according to claim 1, wherein the debris cleaning body having one end rotatably connected to the fixed block; and the debris cleaning plate, to which the other end of debris cleaning body is connected, and to an end portion of which the debris cleaning impeller is connected.

3. The apparatus for cleaning rock debris when deep-water surface drilling is done according to claim 2, wherein the fixed block has an opening end and a fixed end opposite to each other; the fixed block is connected to the outer wall of the open barrel by means of the fixed end, and the debris cleaning body is inserted into the fixed block through the opening end.

4. The apparatus for cleaning rock debris when deep-water surface drilling is done according to claim 3, wherein the fixed block comprises a top wall, a bottom wall, and side walls connected to two sides of the top and bottom walls, and a length of the top wall is larger than a length of the bottom wall.

5. The apparatus for cleaning rock debris when deep-water surface drilling is done according to claim 2, wherein a pulley is provided on an upper portion of the fixed block, a through-hole is formed in the debris cleaning body, and a steel wire rope is provided in the through-hole and wound around the pulley.

6. The apparatus for cleaning rock debris when deep-water surface drilling is done according to claim 2, wherein one end of the pull rod is rotatably connected to the outer wall of the open barrel, and the other end of the pull rod is rotatably connected to a slider disposed around the debris cleaning body.

7. The apparatus for cleaning rock debris when deep-water surface drilling is done according to claim 1, wherein the open barrel is provided on an inner wall thereof with a plurality of rows of rolling structures, each row comprising a plurality of rollers provided at an interval in the circumferential direction of the open barrel.

8. The apparatus for cleaning rock debris when deep-water surface drilling is done according to claim 7, wherein a magnetic block is provided between every two adjacent rollers of the plurality of rollers, and connected to the inner wall of the open barrel.

9. A method for cleaning rock debris when deep-water surface drilling is done, which is implemented by the apparatus for cleaning rock debris when deep-water surface drilling is done according to claim 1, comprising:

step S1: inserting a drill string into the open barrel, the drill string being connected at a lower end thereof with a drill tool;

step S2: lowering the drill string until the apparatus for cleaning rock debris when deep-water surface drilling is done is located above the seabed surface conduit;

step S3: stretching and seating the debris cleaning leg of each of the debris cleaning mechanisms on an upper end face of the seabed surface conduit, wherein the debris cleaning impeller of each of the debris cleaning mechanisms is located at an outer periphery of the seabed surface conduit;

step S4: continuing to lower the drill string until the drill tool reaches a well bottom, and starting the drill tool to perform a drilling operation, wherein the apparatus for cleaning rock debris when deep-water surface drilling is done is driven by the drill string to rotate, and rock debris around the seabed surface conduit is cleaned by the debris cleaning impeller of each of the rock debris mechanisms.

* * * * *